United States Patent [19]

Metz et al.

[11] Patent Number: 4,485,722

[45] Date of Patent: Dec. 4, 1984

[54] RECOIL BRAKE WITH HYDROPNEUMATIC RECUPERATOR AND FORWARD MOVEMENT DAMPING

[75] Inventors: Josef Metz, Neuss; Gert Winkler, Meerbusch, both of Fed. Rep. of Germany

[73] Assignee: Rheinmetall GmbH, Duesseldorf, Fed. Rep. of Germany

[21] Appl. No.: 259,191

[22] Filed: Apr. 20, 1981

[30] Foreign Application Priority Data

Apr. 19, 1980 [DE] Fed. Rep. of Germany ..... 3015097

[51] Int. Cl.[3] ..... F41F 19/14

[52] U.S. Cl. ..... 89/43 R

[58] Field of Search ..... 89/43 R

[56] References Cited

U.S. PATENT DOCUMENTS 997,411 7/1911 Olsson ..... 89/43 R 3,745,880 7/1973 Metz et al. ..... 89/43 R

*Primary Examiner*—Stephen C. Bentley

[57] ABSTRACT

A combination recuperator and gun barrel recoil brake form a single constructional unit assembly. This assembly includes a storage cylinder in which a recoil (brake) cylinder is mounted by means of a separating piston which forms part of the recoil cylinder and which is slidably disposed in the storage cylinder. A recoil piston is slidably disposed in the recoil cylinder and is operatively connected via a piston rod to the gun barrel. A guide bushing is mounted in the rear end wall of the storage cylinder and forms an axial guide for the piston rod of the recoil piston. The outer surface of the guide bushing forms together with the inner wall surface of the recoil cylinder and the internal bore of the separating piston a first passage for permitting a controlled flow of the pressurized liquid between the pressurized liquid chamber in the storage cylinder and the interior of the recoil cylinder. The outer contour of the guide bushing, the inner contours of the recoil cylinder and internal bore of the separating piston are so constructed and arranged that the pressurized liquid is acting on the recoil piston during recoil to firstly, until shortly after the projectile has exited from the gun barrel, only slightly or not at all throttle the flow therethrough, whereby only a reduced or no braking force is applied to the gun barrel, and thereafter the first passage steadily shrinks in size so that an increasing braking force is applied to the gun barrel.

9 Claims, 4 Drawing Figures

RECOIL BRAKE WITH HYDROPNEUMATIC RECUPERATOR AND FORWARD MOVEMENT DAMPING

BACKGROUND OF THE INVENTION

The invention relates to a recoil brake with hydropneumatic recuperator and forward counter-recoil movement damping.

A hydropneumatic recuperator having the aforedescribed features is, for example, disclosed in German Patent DE-PS No. 2053098. (corresponding to U.S. Pat. No. 3,745,880). In the aforedescribed recuperator a separately constructed recuperator cylinder is required which is acting as a brake, and in this known recuperator the recoil damping is initiated immediately at firing. Consequently, a free recoil of the gun barrel is not possible as long as the projectile is still disposed therein. This causes the accuracy of fire to be disadvantageously influenced. Furthermore, this known hydropneumatic recuperator for recoil mechanisms has the drawback of requiring that its constructional length is at least twice as long as the recoil distance, and its operational elements must be assembled in different constructional groups.

SUMMARY OF THE INVENTION

It is an object of this invention to provide a recuperator and gun barrel brake of a recoil mechanism, which is formed as a single constructional group, and whose length is shorter than twice the recoil distance. In this arrangement the recoil damping does only occur when the projectile has left the gun barrel and also the gun barrel counter-recoil advance is firstly weakly braked and thereafter is strongly braked. Furthermore, an automatic heat exchange of hydraulic fluid is possible with the arrangement of the invention, and additionally the arrangement can be adapted for different constructions and different operations of the weapon, in particular the recoil length can be adjusted by simply exchanging certain parts of the arrangement, preferably a single constructional part, for example a guide bushing or a damping or throttling opening.

The arrangement is provided with a recoil cylinder, the inner space of which functions as a brake cylinder. A guide bushing forms part of the arrangement. This guide bushing is provided with openings for permitting the passage of the pressurized fluid between the inner space of the brake cylinder (recoil cylinder) and a storage cylinder. This bushing can be easily exchanged, thereby providing the aforedescribed different operative possibilities for the arrangement. The shortening of the entire constructional group is achieved particularly by means of venting the displacement cylinder filled with pressurized gas into the inner space of the recoil cylinder, so that this is achieved by a coaction between the displacement cylinder and the recoil cylinder.

A two-step braking of the recoil is achieved, in accordance with the invention, in that the guide bushing is constructed in such a way, that two passages are provided for the hydraulic fluid, arranged one behind the other, and are constructed in such a way, that the cross section of the forward passage is constant over the extent of the acceleration phase of the recoil run and thereafter is continuously reduced, whereas the cross section of the rear passage expands over the extent of the acceleration phase of the recoil run, respectively is constant and thereafter continuously shrinks in size. As an alternative to the displacement cylinder there can be provided a forward movement damping mandrel for the two-step braking during the advancing counter-recoil movement. In accordance with the invention, this mandrel is arranged at the forward end of the recoil piston. In this way the hydraulic fluid pushes the advancing damping mandrel, at recoil, out of the recoil piston, said fluid passing through passages in the recoil piston out of the interior of the recoil cylinder. Simultaneously the foward movement throttling damping mandrel, at the end of the advancing movement of the gun barrel, moves counter to the hydraulic fluid pressure and is pushed by means of the foward end wall of the recoil cylinder into the recoil piston, and that the gas pressure chamber includes a throttling opening, which permits the unthrottled streaming of the pressurized gas forwardly during recoil, whereas it increasingly throttles this passage of gas during the advancing counter-recoil movement.

Additionally the new constructional group will indicate the corresponding zero position after termination of the gun barrel advancing movement, by means of an indicating arrangement, which is constructed so that it includes a striker plunger which is slidably guided in the rear end wall of the storage cylinder and is pushed by means of a spring into the interior chamber of the storage cylinder when it is filled with pressurized fluid, whereas when such fluid is lacking, it is pushed from the rear end face of the separating piston counter to the spring force out of the rear end face of the storage cylinder.

In accordance with the invention the guide bushing and the storage cylinder are exchangeable for adjusting or changing the passage cross sections. Furthermore, it is possible to provide a compensation chamber for the pressurized fluid in the inner space of the storage cylinder behind the separating piston.

BRIEF DESCRIPTION OF THE DRAWINGS

The invention will be explained in greater detail by reference to the accompanying drawings and on the basis of certain preferred embodiments.

DETAILED DESCRIPTION

Figure 1:
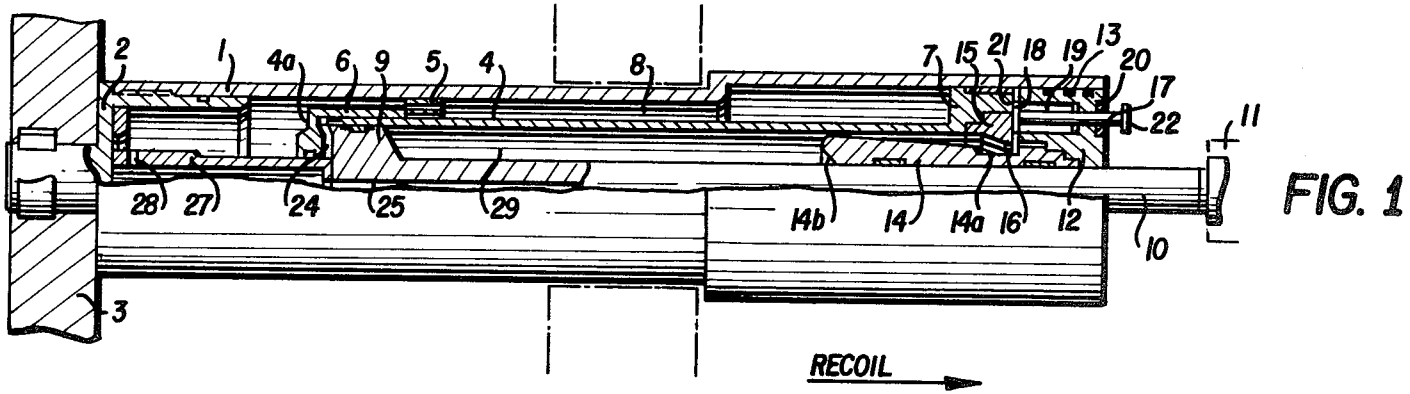
FIG. 1 is a cross-sectional schematic view of a first embodiment having nearly a free recoil.

The storage cylinder 1 for receiving the pressurized gas of the new recuperator-brake-constructional group is fastened with its front end wall 2, for example by means of a bayonet connection, on the gun wall 3 indicated by means of cross-hatching. A recoil cylinder 4 is axially slidably mounted in the storage cylinder 1. This recoil cylinder 4, when in its starting position, contains substantially all of the pressurized fluid for example oil in its inner space 29. This recoil cylinder 4 is closed at its forward (left) end is guided within the storage cylinder 1 by means of a guide ring 6 provided with a throughbore or groove 5. At its rear (right) end the recoil cylinder 6 has a ring-shaped piston 7 which is integral therewith. This piston 7 separates the pressurized gas chamber 8 which surrounds the recoil cylinder 4 and the pressurized fluid which is disposed in the inner chamber 29 of the recoil cylinder 4 behind the recoil piston 9 as well as behind the separating piston 7.

The recoil piston 9 is longitudinally slidably disposed in the recoil cylinder 4; its piston rod 10 is connected at its free end with the weapon housing 11. The inner space 24 of the recoil cylinder 4 between the forward end wall 4*a* of the recoil cylinder 4 and the recoil piston 9 is in communication with the ambient atmosphere by means of a longitudinal bore 25. The rear end wall 12 of the storage cylinder 1 is threadably mounted in an insert piece by means of a threaded connection 13 in the storage cylinder 1. This rear end wall 12 forms the closure for the pressurized gas chamber containing the pressurized fluid. A guide bushing 14 is centrally axially mounted in the end wall 12. A ring insert piece 15, having a connecting passage 16, is mounted between the guide bushing 14 and the separating piston 7. The passage 16 provides communication between the inner chamber 29 of the recoil cylinder 4 and the inner chamber in the rear of the storage cylinder 1 behind the separating piston 7.

A sliding plunger 17 serves as additional means to indicate the presence or absence of pressurized fluid in the inner space of the storage cylinder 1 behind the separating piston 7. The plunger 17 has a front shoulder 18, which in its starting position, abutts against the rear wall 21 of the separating piston 7, whereas its rear shoulder 22, when the recoil cylinder 4 has been moved forwardly, is pushed by a coil spring 19 against the end wall 12, respectively an insert ring 20, in which the plunger 17 is guided.

A displacement cylinder 27 is slidably mounted in a prolongation of the end wall 2 in the front region of the storage cylinder such cylinder 27 axially extending into a front bore of the storage cylinder 1. This displacement cylinder 27 is axially slidable in the guide ring 6, so that it can, during recoil, penetrate into the inner space 24 of the recoil cylinder. The guide bushing 14 has at its rear a limit wall surface 14A, parallel to the piston rod axis, wherein a through-passage 16 is disposed whose length corresponds to the path traversed by the recoil while the projectile is still in the gun barrel. A forwardly conically shaped surface 14B adjoins the axially parallel surface 14A on the guide bushing 14, which conically shaped surface 14B produces an increased braking during the further recoil movement.

Figure 2:
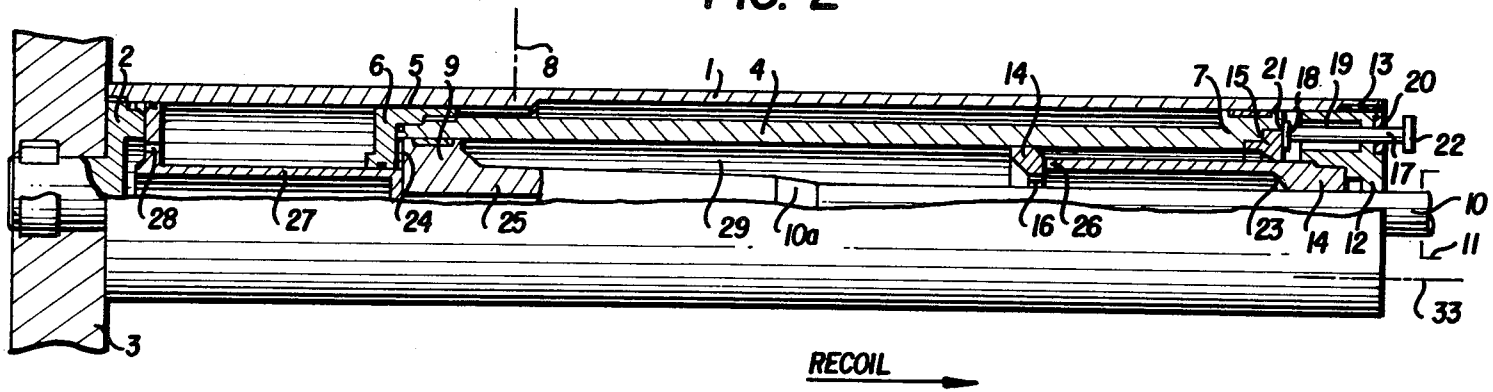
FIG. 2 is a cross-sectional schematic view of a second embodiment having a multi-dampening feature for the recoil.

The embodiment of FIG. 2 substantially distinguishes itself from that of FIG. 1 by providing a modified guide bushing 14. Such modified guide bushing is formed as a hollow body and exhibits in addition to a passage having openings 16 and 26, which firstly permit a non-braked passage of the pressurized fluid, a further throttling opening 23 which acts with increased braking effect in view of the conically shaped limit wall of the ring insert 15. Only after the traversing of a predetermined path by the gun barrel and thereby the piston rod 10, a braking effect through the opening 16 occurs, that is when it is reached by a conical region 10*a* of the piston rod 10. In addition thereto, the embodiment of FIG. 2 includes a modified version of the displacement cylinder 27, whereby the modified cylinder 27 has a forward region which bears directly against the inner wall of the storage cylinder 1 and has the passages 5 and 28.

Figure 2A:
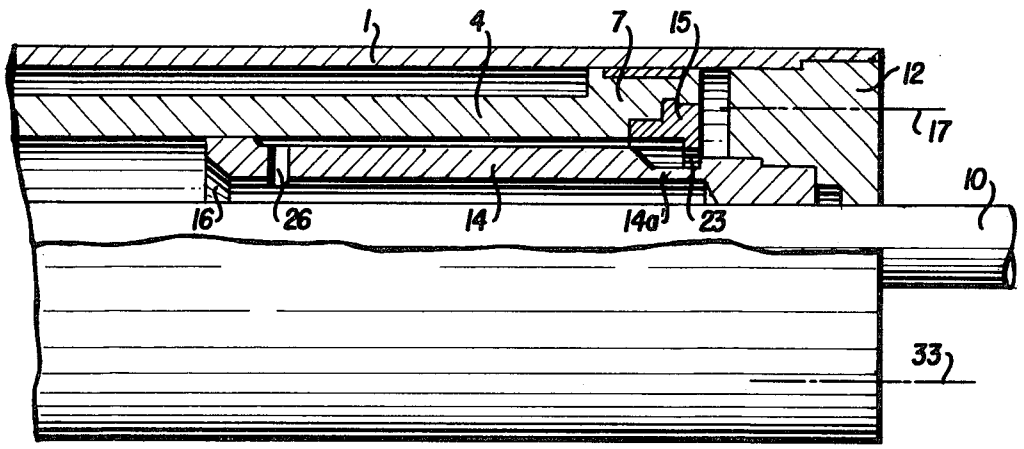
FIG. 2*a* is a cross-sectional view of a detail of the embodiment of FIG. 2 wherein the guide bushing is modified.

According to FIG. 2*a* the guide bushing 14 is similar to the configuration of the guide bushing of the embodiment of FIG. 1. Thus it has a limit wall 14A' which is parallel to the piston rod 10, so that in the acceleration phase of the recoil movement no braking or only a limited braking of the gun barrel occurs.

Figure 3:
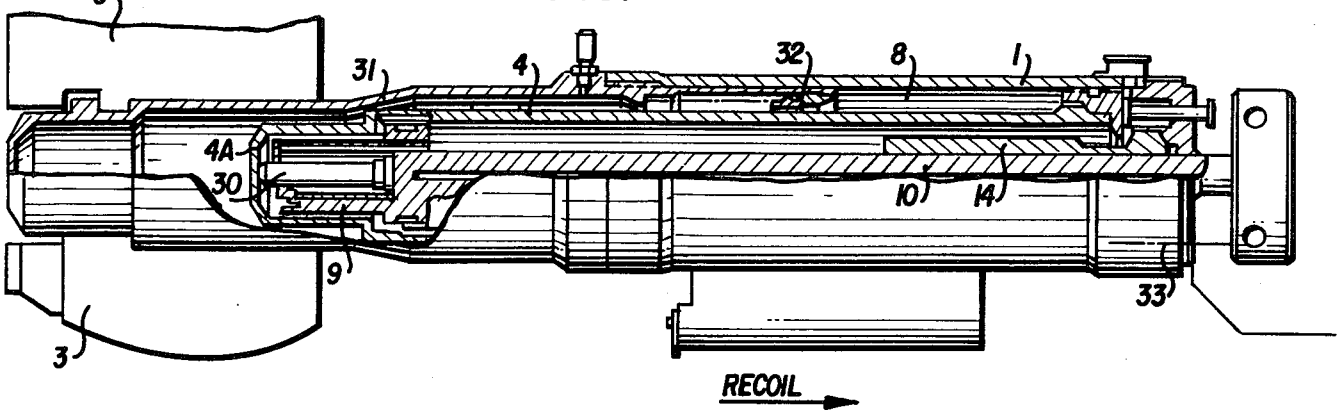
FIG. 3 is a cross-sectional schematic view of a third embodiment of the invention having a forward movement throttling mandrel.

A further embodiment of the invention is illustrated in FIG. 3, wherein the guide bushing 14 corresponds substantially to the guide bushing of the embodiment of FIG. 1. In lieu of the displacement cylinder 27 there is provided in the recoil piston 9 a forward movement throttling mandrel 30 which can abutt with its front end against the front end wall 4*a* of the recoil cylinder 4.

Furthermore, the recoil piston 9 is provided with through-passages 31 for permitting the passage of the pressurized fluid into the space behind the forward movement throttling mandrel 30. Furthermore there is arranged in the pressurized gas chamber 8 a throttling member 32 in such a way that, during recoil of the gun barrel, a non-throttled compression of the pressurized gas occurs, whereas during the advancing counter-recoil movement its throttled expansion is effected.

MANNER OF OPERATION

The recoil operation of this invention operates so that the recoil piston 9, is entrained to its right, as viewed in the drawings, by means of the piston rod 10 which is recoiled due to the pressure of the powder gas occurring in the gun barrel. Thereby the pressurized fluid is pushed out of the inner space 29 of the recoil cylinder 4, firstly in an unbraked manner or nearly unbraked manner and thereafter with an increased braking force via the openings 16, respectively 16, 26 and 23 into the inner space of the storage cylinder 1 behind the ring-shaped separating piston 7. Thereby the recoil cylinder 4 is slid to its left as viewed in the drawings, that is opposite to the direction of movement of the recoil piston 9 and the gas present in the pressurized gas chamber 8 is pushed through the openings 5 and 28 into the inner space of the displacement cylinder 27 and is compressed therein. The displacement cylinder 27 is caused to slide into the interior of the recoil cylinder 4.

In the embodiment having the forward counter-recoil movement throttling mandrel 30 (FIG. 3) the pressurized gas is simply compressed in the pressurized gas chamber. However, simultaneously pressurized fluid passes through the channel 31 in the recoil piston 9 into the chamber behind the forward movement throttling mandrel 30 and pushes it forwardly.

After termination of the recoil movement the pressure of the compressed gas acts on the displacement cylinder 4 and the separating piston 7 to effect the forward movement of the gun barrel. The forward movement is firstly relatively weakly braked by means of the throttling passage 5. Only when the recoil piston 9 is pushed by the return-flowing pressurized fluid, flowing through the passages 16, respectively 23, 26 and 16, against the displacement cylinder 27, which projects into the inner space 24 of the recoil cylinder 4, there results a stronger braking, since the pressurized gas can only slowly pass through the throttling bore 28.

In the embodiment of FIG. 3 there results the first braking during the advancing motion by means of the throttling mandrel 32 and the immediately following second, stronger braking, as soon as the forward movement throttling mandrel 30 is pushed against the forward end wall 4*a* of the recoil cylinder, since the hydraulic fluid can escape out of the chamber in front of the forward movement throttling mandrel 30 in the recoil cylinder 9 through the throttling passage 31 only slowly into the inner space of the recoil cylinder 4.

There is present air in the inner chamber 24 of the recoil cylinder 4 after the recoil, which escapes during the forward movement through the longitudinal bore 25. Nitrogen is used preferably as the pressurized gas. This pressurized gas is introduced under pressure of about 18 bar in the pressurized gas chamber and is compressed during recoil to about 60 bar. In the embodiment of the invention having the forward movement throttling mandrel, an increase in the over all length of the construction, as compared to the other emdodiments, can be avoided by increasing the pre-pressure of the pressurized gas.

As pressurized hydraulic fluid there is, preferably, used oil, which for example can be introduced through the opening 33 in an uncompressed state, but during recoil is compressed to about 620 bar. The recoil throttling can be easily adapted to the prevailing conditions by adjusting the throttling cross-section of the passage 28.

A particular advantage in the new gun barrel brake-gun barrel recoil combination resides in that with recoiled gun barrel a vacuum-containing chamber is not formed. Consequently no air enters into the brake cylinder, which air could lead to disturbances or malfunction of the firing operation and which would also require a time-consuming venting. Additionally in the novel constructions of the invention there is effected a compensation of volume expansions of the hydraulic oil as a result of temperature changes, so that an auxiliary compensation container is not required.

Although the invention is illustrated and described with reference to a plurality of preferred embodiments thereof, it is to be expressly understood that it is in no way limited to the disclosure of such preferred embodiments, but is capable of numerous modifications within the scope of the appended claims.

We claim:

1. An improved recoil brake for a gun barrel having a hydropneumatic recuperator and forward movement damping, including a recoil cylinder which is slidably mounted in a storage cylinder for pressurized gas, a separating piston slidable in the storage cylinder and rigidly secured to the recoil cylinder, said separating piston separating the storage cylinder into variable pressurized gas and pressurized liquid chambers, a guide bushing being axially mounted in the recoil cylinder, a piston rod axially slidably mounted in said guide bushing and having at one of its ends a piston axially rigidly secured thereto which piston is slidably disposed in the recoil cylinder, the gun barrel being secured to the other end of said piston rod, first passage means for the pressurized liquid being provided between the inner space of the recoil cylinder and the inner space of the storage cylinder in its rear end region that is behind the separating piston and in front of its rear end wall, and second passage means being provided for the pressurized gas between the pressurized gas chamber disposed behind a guide ring means in the storage cylinder in which the recoil cylinder is operatively mounted and the inner space of the storage cylinder disposed in front of the guide ring means:

the improvement, comprising in combination, (a) wherein said guide bushing is constructed and arranged in such a way that first passage means cause the pressurized liquid to be firstly, until shortly after exiting of the projectile from the gun barrel, slightly, or not at all throttled during recoil, whereby only a reduced or no braking force is being applied to the gun barrel, whereafter said first passage means are increasingly reduced in size to thereby exert an increased braking force on the recoiling gun barrel; and (b) in the front region of the storage cylinder between internal wall of the storage cylinder and internal surface of the guide ring means for the recoil cylinder, which functions as a brake cylinder, a displacement cylinder is slidably guided in such a way that it is adapted to penetrate with its closed end into the inner space of the recoil cylinder, said displacement cylinder being provided with third throttling passage means to provide a passage between the interior of the displacement cylinder and the pressurized gas chamber in the storage cylinder.

2. The improvement in a recoil brake for a gun barrel having a hydropneumatic recuperator and forward movement damping as set forth in claim 1, wherein said guide bushing is constructed and arranged in such a way that two passages are provided, one behind the other with respect to the direction of flow of the pressurized liquid, so that the upstream passage is constant during the acceleration phase of the recoil movement and thereafter steadily decreases in size, whereas the cross-section of the downstream passage expands or remains constant along the extent of the acceleration phase and thereafter steadily decreases in size.

3. The improvement in a recoil brake for a gun barrel having a hydropneumatic recuperator and forward damping as set forth in claim 2, that in lieu of said displacement cylinder a forward movement throttling mandrel is operatively mounted in the piston of the recoil cylinder in such a way that the hydraulic pressurized liquid is forced out of the interior of the recoil cylinder during recoil via passages provided in said piston of said recoil cylinder and thereby said mandrel is pushed out of said piston, whereas the mandrel at the end of the recoil is pushed into the piston of the recoil cylinder by making contact against an end wall on said recoil cylinder against the action of the hydraulic pressurized liquid, and throttling means being provided in the pressurized gas chamber which permits the forward unthrottled flow of the pressurized gas during recoil, whereas during forward movement of the gun barrel it increasingly throttles the gas flow therethrough,

4. The improvement in a recoil brake for a gun barrel having a hydropneumatic recuperator and forward damping as set forth in claim 1, wherein said storage cylinder has a Crear end wall, a plunger slidingly disposed in a bore of said rear end wall, a coil spring operatively mounted in said bore and biasing said plunger into the interior of the rear region of said storage cylinder behind the separating piston and in front of its rear end wall which is filled with pressurized hydraulic liquid, whereas when pressurized hydraulic liquid is lacking in said interior of the rear region of said storage cylinder the rear end face of the separating piston pushes the plunger out of the interior of the storage cylinder through said bore in said rear wall against the bias of the coil spring disposed in said bore.

5. The improvement in a recoil brake for a gun barrel having a hydropneumatic recuperator and forward movement damping as set forth in claim 4, wherein said guide bushing and said displacement cylinder are exchangeably mounted in said hydropneumatic recuperator and can be replaced by a guide bushing and displacement cylinder respectively having different first passage means or third throttling passage means.

6. The improvement in a recoil brake for a gun barrel having a hydropneumatic recuperator and forward movement damping as set forth in claim 5, including a pressure compensation chamber disposed in the interior of the storage cylinder behind the separating piston.

7. A hydropneumatic recuperator adapted to be operatively connected to a gun barrel, comprising in combination, a storage cylinder having a forward region and forward end wall and rear region and rear end wall;

a recoil cylinder having a separating piston with an internal bore which is fixedly mounted on its rear end is slidably disposed inside said storage cylinder, said separating piston separating said storage cylinder into said forward and rear regions, which respectively correspond to a variable pressurized gas and a pressurized liquid chamber;

a guide bushing axially mounted in said rear end wall and extending into said recoil cylinder;

a piston rod having a recoil piston secured to its forward end is slidably mounted in said guide bushing, said piston rod being adapted to be operatively connected to the gun barrel of a gun;

first passage means are operatively mounted on said guide bushing and in said internal bore of said separating piston for providing a passage for the pressurized liquid between said rear region and the interior of said recoil cylinder, the cross-section of which is partially defined by the exterior periphery of said guide bushing and partially by the interior wall surface of said recoil cylinder;

second passage means are operatively mounted in said forward region of said storage cylinder for adjusting the gas pressure in said forward region;

said first passage means being constructed and arranged in such a way that the pressurized liquid acting on the recoil piston during recoil to firstly, until shortly after the projectile has exited from the gun barrel, only slightly or not at all throttling the flow therethrough, whereby only a reduced or no braking force is applied to the gun barrel, and thereafter said first passage means steadily shrinks in size so that an increasing braking force is applied to the gun barrel.

8. The hydropneumatic recuperator as set forth in claim 7, wherein said second passage means includes a displacement cylinder, the forward end of said recoil cylinder defining an axial bore in which said displacement cylinder is slidably mounted, and a throttling passage in said displacement cylinder for permitting the passage of pressurized gas therethrough; said displacement cylinder being adapted to coact with the recoil piston to adjust its position in the recoil cylinder during counter-recoil movement of the gun barrel.

9. The improvement in a recoil brake for a gun barrel having a hydropneumatic recuperator and forward movement damping as set forth in claim 7, wherein said recoil piston includes a bore in which a throttling mandrel is axially slidably mounted, and the forward end of said recoil cylinder is being formed by a closed end wall, the recoil piston having passages which connect the bore with the interior of the recoil cylinder, whereby the hydraulic pressurized fluid is forced through the passages and into the bore during recoil thereby pushing the mandrel out of bore, whereas the mandrel at the end of the recoil is pushed into the piston of the recoil cylinder by making contact against the closed end wall on said recoil cylinder against the action of the hydraulic pressurized liquid, and said second passage means including throttling means operatively mounted in the pressurized gas chamber which permits the forward unthrottled flow of the pressurized gas during recoil, whereas during counter-recoil forward movement of the gun barrel it increasingly throttles the gas flow therethrough.

* * * * *